US006679066B1

(12) United States Patent
Funayama et al.

(10) Patent No.: US 6,679,066 B1
(45) Date of Patent: Jan. 20, 2004

(54) CRYOGENIC COOLING SYSTEM FOR SUPERCONDUCTIVE ELECTRIC MACHINES

(75) Inventors: Shin Funayama, Tokorozawa (JP); Kazuhiro Nomi, Niiza (JP)

(73) Assignee: Sumitomo Heavy Industries, Ltd., Tokyo (JP)

( * ) Notice: Subject to any disclaimer, the term of this patent is extended or adjusted under 35 U.S.C. 154(b) by 0 days.

(21) Appl. No.: 10/219,279

(22) Filed: Aug. 16, 2002

(51) Int. Cl.[7] ..... F17C 9/02; F25B 9/00; F25B 1/06

(52) U.S. Cl. ..... 62/50.2; 62/500; 62/6

(58) Field of Search ..... 62/643, 6, 50.2, 62/515, 500, 259.2

(56) References Cited

U.S. PATENT DOCUMENTS 4,578,962 A * 4/1986 Dustmann ..... 62/515
5,461,871 A * 10/1995 Bracque et al. ..... 62/643
6,347,522 B1 * 2/2002 Maguire et al. ..... 62/6
6,378,312 B1 * 4/2002 Wang ..... 62/6

* cited by examiner

*Primary Examiner*—William C. Doerrler
(74) *Attorney, Agent, or Firm*—Arent Fox Kintner Plotkin & Kahn, PLLC

(57) ABSTRACT

A part of a refrigerant in the low-temperature state is circulated by a cryogenic cooling system for superconductive electric machines comprising a refrigerant transfer system and circulation means for internal circulation within the cryogenic area, thereby enabling improvement in the cooling efficiency.

10 Claims, 2 Drawing Sheets

CRYOGENIC COOLING SYSTEM FOR SUPERCONDUCTIVE ELECTRIC MACHINES

BACKGROUND OF THE INVENTION a) Field of the Invention

The present invention relates to a cryogenic cooling system for superconductive electric machines, and more particularly, relates to a cryogenic cooling system for superconductive electric machines suitably used for cooling equipments that require a large refrigeration load such as a superconductive generator, and effective for improvement in efficiency and miniaturization of an apparatus.

b) Description of the Related Art

A superconductive generator requires cooldown for lowering the temperature of a rotor to the operating temperature thereof, and cryogenic cooling for maintaining the rotor in a low temperature for the normal operation.

However, with regard to cooling of the superconductive generator, no attempt has heretofore been made worldwide to put it to practical use. As a conception, there can be considered to circulate cryogenic liquid helium from outside to effect cooling. This is because since the superconductive generator has a rotor, it is difficult to soak it directly in the liquid helium.

However, with the method of circulating the liquid helium from outside to cool the superconductive generator, the liquid helium is warmed up and gasified, at the time of cooling the superconductive generator. Therefore, it is necessary to throw away the warmed and gasified helium to prevent becoming high pressure state, and to supplement the liquid helium at all times, causing a problem in that much labor and cost are required.

SUMMARY OF THE INVENTION

It is an object of the present invention to efficiently attain two objectives: cooldown of an object to be cooled up to the operating temperature; and maintaining a low temperature for the normal operation.

It is another object of the present invention to increase the redundancy of the system to thereby improve the reliability.

In order to achieve the above-described objects, the present invention provides a cryogenic cooling system for superconductive electric machines comprising a refrigerant transfer system and circulation means for internal circulation within the cryogenic area.

The superconductive electric machines ma y be a generator, a motor, a coil, a bulk or the like.

The cryogenic cooling system for the superconductive electric machines may comprise a cryocooler for cooling a system, a forced flow refrigerant transfer system for cooling the superconductive electric machines, and a cold box for housing the cryocooler and the transfer system.

The inside of the cold box may be vacuum.

There may be provided, outside of the cold box, at least one compressor for supplying high pressure refrigerant gas to the cryocooler, and a circulation pump for circulating the refrigerant gas to the forced flow transfer system.

The cold box may comprise: at least one closed cycle cryogenic refrigerator; a heat exchanger; at least one rejection heat exchanger provided on the cryogenic refrigerator; and piping for forcedly circulating the refrigerant gas.

Also, the redundancy of the system is increased to improve the reliability, by providing a plurality of cryogenic refrigerators.

Moreover, a sleeve for removing the cryogenic refrigerator from the cold box is provided to thereby make the maintenance easy.

An ejector for directly returning a part of the refrigerant gas returning from the superconductive electric machine to the rejection heat exchanger is also provided, thereby enabling improvement in efficiency.

Furthermore, a radiation shield plate for insulating the cryogenic area from the radiation from the normal temperature area is provided to thereby improve the cooling performance.

As described above, by directly circulating a part of the refrigerant in the low-temperature state, the amount of refrigerant passing through the heat exchanger on the normal temperature side is reduced, thereby enabling improvement in the overall thermal efficiency. Moreover, the apparatus can be made small by reducing the size of the heat exchanger and making the circulation pump small.

DETAILED DESCRIPTION OF THE PREFERRED EMBODIMENTS

Embodiments of the present invention applied to a superconductive generator will now be described in detail, with reference to the drawings.

Figure 1:
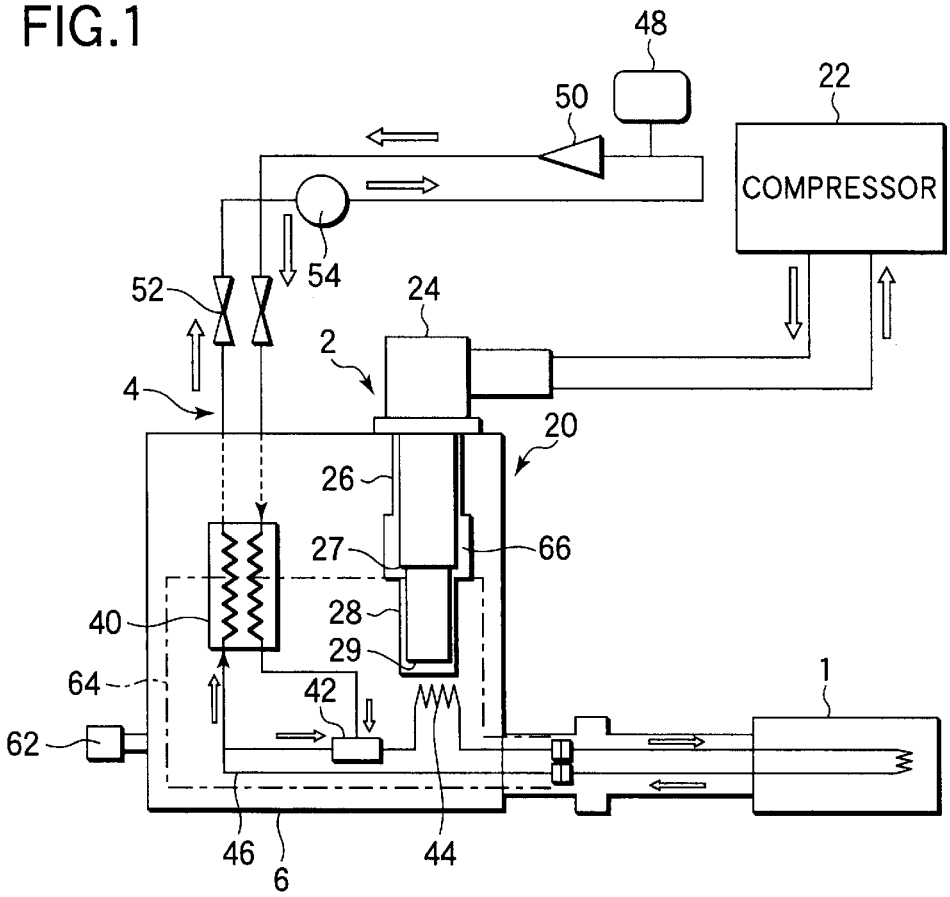
FIG. 1 is a pipe line diagram showing the construction of a first embodiment of a cryogenic cooling system for a superconductive generator according to the present invention.

FIG. 1 shows a first embodiment of a cryogenic cooling system for a super conductive generator according to the present invention. This system mainly includes a cryocooler 2 for cooling the system, a forced flow helium transfer system 4 for cooling a superconductive generator 1 to an extremely low temperature such as 30–40K, and a cold box 6 for housing the cryocooler 2 and components in the transfer system 4.

The cold box 6 includes: a closed cycle cryogenic refrigerator, for example, Gifford-McMahon cycle refrigerator (GM refrigerator) 20; a counterflow heat exchanger 40; an ejector 42; a rejection heat exchanger 44 fitted to a point (bottom in the figure) flange 29 where the temperature is lowest in the GM refrigerator 20; and pipes 46 for the transfer system 4.

The GM refrigerator 20 includes: a valve head 24 for supplying a refrigerant (for example, helium gas) supplied from a compressor 22 to a displacer (not shown) built in a cylinder; a first stage 26 for cooling an intermediate flange 27 to about, for example, 50K; and a second stage 28 for cooling the heat exchanger 44 fitted to the bottom flange 29 to an extremely low temperature as low as, for example 20K. The details of this GM refrigerator are described in Japanese Patent No. 2659684 (if there is a corresponding USP, please replace this), and therefore the description thereof is omitted.

Figure 2:
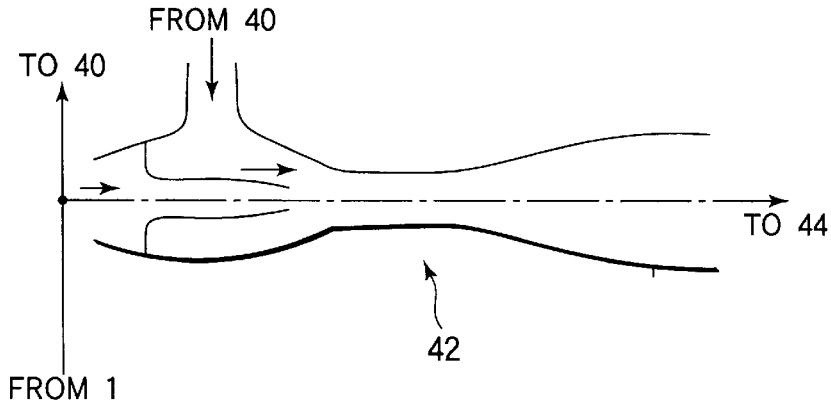
FIG. 2 is a sectional view showing a sectional shape of an ejector used in the first embodiment.

The ejector 42 has a sectional shape as shown in FIG. 2, for example. The flow coming out from this ejector 42 passes through the rejection heat exchanger 44, and is cooled before entering the generator 1. This ejector is for reducing a thermal loss in the heat exchanger 40 to thereby improve the thermal performance of the whole system, by minimizing the flow passing through the heat exchanger 40, and may be omitted. Details of the ejector are described in Japanese Patent Laid-Open Publication No. Hei 10-311618 (if there is a corresponding USP, please replace this), and therefore the description thereof is omitted.

The cold box 6 is a vacuum container for preventing heat transfer by means of air and convection to enhance the insulation effectiveness, and maintain an extremely low temperature. A vacuum port 62 is provided in this cold box 6, so that the cold box 6 is evacuated to create a vacuum therein.

In the cryogenic area within the cold box 6, a radiation shield plate 64 consisting of, for example, a copper plate is provided for insulating from the radiant heat from the normal temperature area. This shield plate 64 is cooled to, for example, about 50K, by means of the first stage 26 in the GM refrigerator 20.

Outside of the cold box 6, there are provided the compressor 22 for supplying high pressure helium to the valve head 24 of the GM refrigerator 20, a buffer tank 48 for circulating the helium gas to the forced flow transfer system 4, a circulation pump 50, a flow control valve 52, and a mass flow meter 54.

The GM refrigerator 20 is fitted to the cold box 6 via a sleeve 66. This sleeve 66 makes it possible to pull out the GM refrigerator 20 upwards from the cold box 6 and remove it, thereby facilitating the maintenance. Details of the sleeve are described in, for example, Japanese Patent Laid-Open Publication No. Hei 8-279412 (please replace this with a corresponding USP), and the description thereof is omitted.

The generator 1 is cooled by the helium gas circulated by the circulation pump 50 in the transfer system 4. The helium gas is cooled by the GM refrigerator 20 in the middle of the circulation line. The compressor 22 is connected to the GM refrigerator 20, for performing adiabatic cooling continuously in the closed circuit.

The helium gas compressed by the circulation pump 50 passes through the flow control valve 52 so that the flow rate is adjusted, to thereby perform heat exchange with the return gas by the heat exchanger 40. The gas coming out from the heat exchanger 40 is transferred to the heat exchanger 44 through the ejector 42, and is cooled to about 20K by the second stage 28 in the GM refrigerator 20. Thereafter, the gas is transferred to the generator 1 to cool the generator 1, and then returned again to the heat exchanger 40. On the halfway, a part of the gas branches and returns to the ejector 42. That is to say, a part of the helium gas returning to the heat exchanger 40 from the generator 1 is drawn into the ejector 42 side, due to the pressure of the helium gas that has flowed initially from the heat exchanger 40 to the heat exchanger 44. As a result, the cooling gas circulating within the cold box 6 and the generator 1 increases, so as to reduce the amount of gas returning to the normal temperature area, such as the circulation pump 50 or the like.

Figure 3:
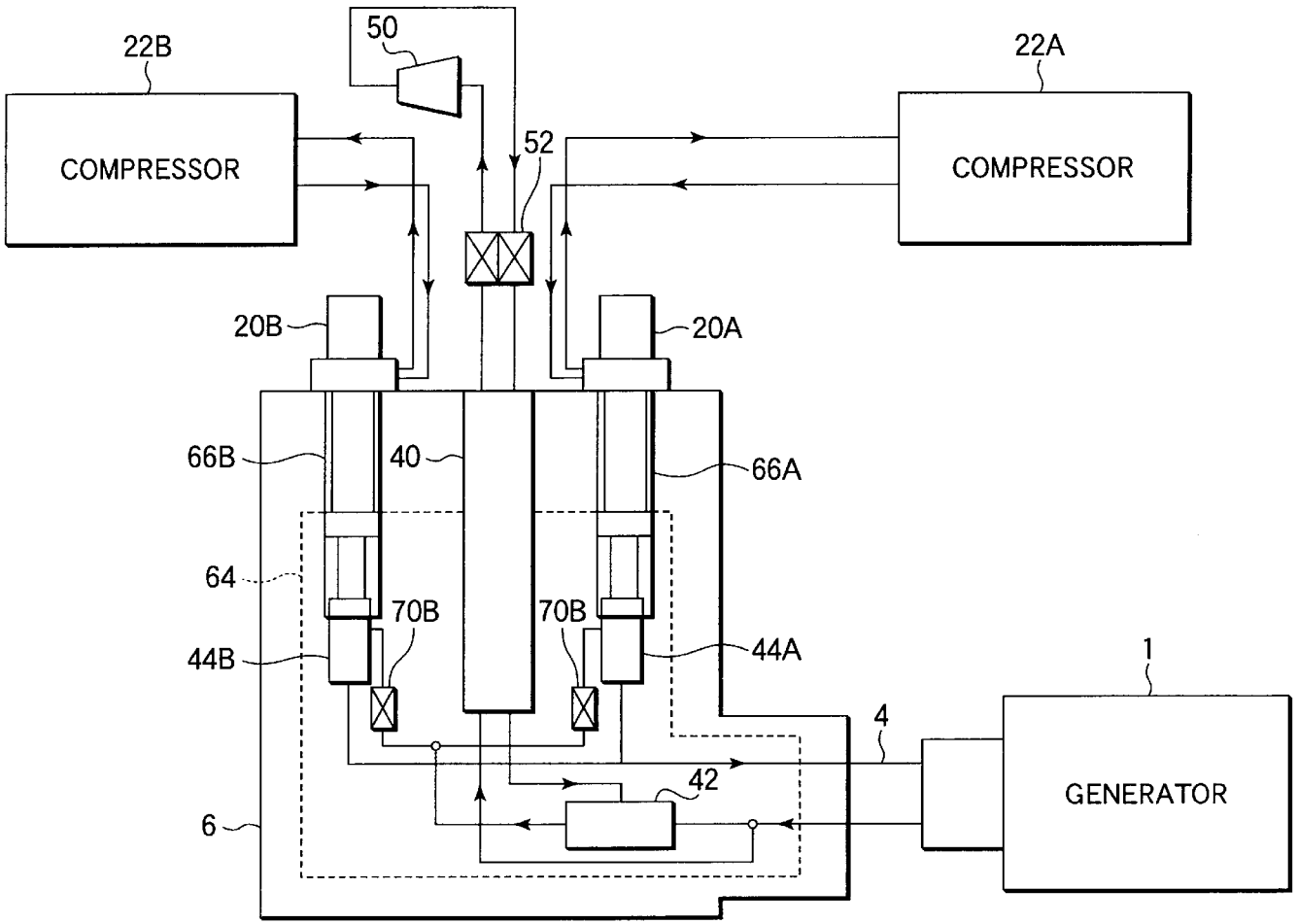
FIG. 3 is a pipe line diagram showing a second embodiment of a cryogenic cooling system for a superconductive generator according to the present invention.

Next, a second embodiment of the present invention will be described, with reference to FIG. 3.

In this embodiment, the refrigerator 20, the compressor 22 and the heat exchanger 44 are provided in two systems A, B, in the same cryogenic cooling system as in the first embodiment, so that these can be changed over by means of flow valves 70A, 70B.

In this embodiment, in the normal operating mode, for example, by closing the flow valve 70B and opening only the flow valve 70A, the flow to the refrigerator 20B and the heat exchanger 44B is stopped, and flow exists only on the refrigerator 20A side. On the other hand, in the cooldown mode, the flow valves 70A, 70B are both opened, to operate two refrigerators 20A, 20B at the same time, to thereby provide double cooling capacity to the helium transfer system.

By duplicating the refrigeration system in this manner, it becomes possible to remove the refrigerator from the system, without stopping the generator 1 to effect service interruption or without warming up the system, thereby enabling improvement in the reliability of the system. At this time, it is possible to remove the refrigerator from the cold box 6, without disturbing the operation of the other refrigerator, or disturbing cooling of the generator 1, by means of sleeves 66A, 66B.

In the above embodiments, the present invention is applied to cooling of the generator. However, the application of the present invention is not limited thereto, and it is obvious that the present invention can be similarly applied to cooling of superconductive motors, superconductive magnets (coils), and rotors of other superconductive electric machines. Also, the refrigerant is not limited to helium.

What is claimed is:

1. A cryogenic cooling system for superconductive electric machines comprising a superconductive electric machine;

a forced flow refrigerant transfer system for cooling the superconductive electric machine;

a circulation pump for internal circulation within the refrigerant transfer system;

wherein said refrigerant transfer system comprises a cryocooler;

and further comprising a cold box for housing said cryocooler and said transfer system;

wherein said cold box comprises:

at least one closed cycle cryogenic refrigerator;

a heat exchanger;

at least one rejection heat exchanger provided on said cryogenic refrigerator; and piping for forcedly circulating the refrigerant gas; and an ejector for directly returning a part of the refrigerant gas returning from the superconductive electric machine to said rejection heat exchanger.

2. The cryogenic cooling system according to claim 1, wherein said superconductive electric machine is a generator.

3. The cryogenic cooling system according to claim 1, wherein said superconductive electric machine is a motor.

4. The cryogenic cooling system according to claim 1, wherein said superconductive electric machine is a coil.

5. A cryogenic cooling system for superconductive electric machines comprising:

a cryocooler for cooling a system;

a forced flow refrigerant transfer system for cooling a superconductive electric machine;

a cold box for housing said cryocooler and said transfer system;

wherein said cold box comprises:

at least one closed cycle cryogenic refrigerator;

a heat exchanger;

at least one rejection heat exchanger provided on said cryogenic refrigerator; and piping for forcedly circulating the refrigerant gas; and an ejector for directly returning a part of the refrigerant gas returning from a superconductive electric machine to said rejection heat exchanger.

6. The cryogenic cooling system according to claim 5, wherein inside of the cold box is made vacuum.

7. The cryogenic cooling system according to claim 6, wherein the system is provided outside of said cold box with:

at least one compressor for supplying high-pressure refrigerant gas to said cryocooler; and a circulation pump for circulating the refrigerant gas to said forced flow refrigerant transfer system.

8. The cryogenic cooling system according to claims 5, wherein a plurality of cryogenic refrigerators are provided.

9. The cryogenic cooling system according to claim 5, wherein a sleeve for removing said cryogenic refrigerator from the cold box is provided.

10. The cryogenic cooling system according to claim 5, further comprising a radiation shield plate for insulating the cryogenic area from the radiation from the normal temperature.

* * * * *